United States Patent [19]

Bohmig

[11] Patent Number: 4,884,093

[45] Date of Patent: Nov. 28, 1989

[54] APPARATUS FOR THE DEVELOPMENT ESPECIALLY OF A FILM SHEET OF A FILM PUNCHED CARD

[75] Inventor: Wolfgang Bohmig, Markgroningen, Fed. Rep. of Germany

[73] Assignee: Zeutschel GmbH & Company, Tubingen, Fed. Rep. of Germany

[21] Appl. No.: 135,974

[22] Filed: Dec. 21, 1987

[30] Foreign Application Priority Data

Dec. 22, 1986 [DE] Fed. Rep. of Germany ..... 3644050

[51] Int. Cl.[4] ..... G03D 5/00

[52] U.S. Cl. ..... 354/299; 354/317; 354/324

[58] Field of Search ..... 354/299, 317, 324; 355/27

[56] References Cited

U.S. PATENT DOCUMENTS

| | | | |
|---|---|---|---|
| 2,587,350 | 2/1952 | Miwald | 354/317 |
| 2,665,619 | 1/1954 | Tuttle et al. | 354/317 |
| 2,981,170 | 4/1961 | Brault | 354/317 |
| 3,149,550 | 9/1964 | Lohse et al. | 354/299 |
| 3,744,394 | 7/1973 | Firth | 354/299 |
| 3,748,995 | 7/1973 | Schroter et al. | 354/299 |
| 3,936,854 | 2/1976 | Smith | 354/299 |

*Primary Examiner*—A. A. Mathews

*Attorney, Agent, or Firm*—Bachman & LaPointe

[57] ABSTRACT

An apparatus for the development of an emulsion coating, especially of a film sheet of a film punched card, with a development chamber which is limited on one side by the emulsion coating and is arranged in the path of flow of fluid(s) for the one part and air for the other, is to be so improved that a minimum possible chemical consumption with optimum development operation ensue. More especially a development chamber of new conception is to be produced. For this purpose the development chamber (22) comprises a gap chamber (37) of rectangular plan of a height (i) of about 0.1 to 1.0 mm. and is limited in relation to a carrier surface, determining the position of the emulsion coating (12), of a frame rib (39) with seal edge (40) by the surface (35) of a heated chamber body (29). The surface thereof is bevelled off at each of the two edges (34) cross ing the flow direction (x) of the fluid(s) to form a side groove (30) extending approximately over the entire height (n) of the chamber body, the bevelled-off edge and the side groove being parts of a flow gap (23, 23$_e$) of approximately the width (t) of the part of the surface of the chamber body liberated by the s eal edge and being corrected to an inlet (61) and outlet (83) for fluids and air.

18 Claims, 3 Drawing Sheets

APPARATUS FOR THE DEVELOPMENT ESPECIALLY OF A FILM SHEET OF A FILM PUNCHED CARD

DESCRIPTION

The invention relates to an apparatus for the development of an emulsion coating, especially of a film sheet of a film punched card, with a development chamber which is limited on one side by the emulsion coating and is arranged in the path of flow of fluid(s) for the one part and air for the other part.

In apparatuses of this kind a relatively high spray chamber is provided beneath the clamped-in film punched card, and for the one part consumes a disproportionately large quantity of the requisite chemicals which are sprayed in this spray chamber against the emulsion coating and collect at the bottom of the development chamber. The walls of this development chamber are then wetted with chemicals which cannot be removed to an adequate extent even by blown air which is necessary for drying.

The Inventor has set himself the target of so improving an apparatus of the initially mentioned kind that a minimum possible consumption of chemicals occurs with an optimum developing operation. More especially a development chamber of new conception is to be produced.

The fact that the development chamber comprises a gap space of substantially rectangular plan view with a low height of preferably 0.25 mm. and is limited by the surface of a heated chamber body in relation to a carrier surface, determining the position of the emulsion coating, of a frame rib leads to the solution of this problem; the heated body surface is bevelled off, on both edges which cross the direction of flow of the fluid(s), to form in each case a side groove extending over the entire height of the chamber body—or may instead be rounded in streamlined form—and this bevelled edge and the side groove are parts of a flow gap approximately of the width of the part of the surface of the chamber body liberated by the sealing edge or frame rib and are connected to an inlet and/or outlet for fluid. The width of the lateral flow gaps here corresponds approximately to the height of the gap chamber.

The slight cross-section throughout of this gap chamber guarantees the desired low consumption of chemicals since only an extremely thin fluid layer must be conducted through the gap. Since the chamber body itself is heated in regulated manner and the spacing of this heating and the emulsion coating is very small, with the apparatus according to the invention a substantially improved temperature control also results in the development zone. Thus it is also guaranteed that the film is kept cooler than the bath, so that the moisture can settle on the emulsion coating. This too is only defectively achievable in the prior art as described.

With regard to the mentioned control of temperature and process it has proved favourable to form the chamber body as a metal block with at least one bore directed parallel to its surface for a heating cartridge and with a security against overheating, while parallel with the bore(s) there extend front plates of the side grooves which adjoin parts of a cover frame possessing the seal edge and comprising inner faces parallel to the bevelled edges of the chamber body. This production of the lateral flow gap sections by means of side grooves is especially simple in production technique. The measure of extending the side groove in each case nearly over the whole width of the chamber body furthermore leads to favourable flow conditions.

Further advantages and features of the object of the invention may be seen from the sub-claims.

With the development chamber in accordance with the invention it is possible in place of the spraying usual hitherto to carry out a dip development, namely first developer, next fixing fluid and then water being conducted through the narrow gap chamber and then a switch-over to drying with intermediate moistening. About 250 film punched cards will be developed per liter of chemicals with a high resolution capacity and low background fog (at least 180 lines with 29.7 times reduction). Moreover an absolute temperature stability is guaranteed. The temperature regulation takes place electronically with an accuracy of ±0.5° C.

The intensive after-watering, which can be carried out especially simply with the switch-over device as described in the sub-claims, by direct rinsing guarantees a library-type stability of the microfilms even after a long time of currency.

In conclusion the advantages of the apparatus according to the invention and of the process to be carried out therewith may be listed once again:

- rapid and simultaneous wetting by prior swelling of the emulsion coating and simultaneous automatic venting of the development chamber—consequently rapid unsqueezing without rise in background fog;
- absolute cleanliness and dryness of the development chamber after every single development cycle;
- no possibility of mixing of a through-flooding chemical substance with earlier chemical particles—this requirement is of special importance for colour film development;
- adjustable processing times without compulsory rise of the chemical consumption;
- uniform wetting of the film due to a special shaping of the flow chamber;
- drying by the three-stroke process through surface-active air meter without contact of the emulsion coating with compressed air and intermediate moistening, steplessly adjustable to all climatic ranges;
- absolutely pressureless chemical transport;
- several different processes executable directly one after the other and without expensive cleaning or conversion work.

Further advantages, features and details of the invention appear from the following description of preferred examples of embodiment and with reference to the drawing, wherein.

Figures 1, 2, 3, 4:
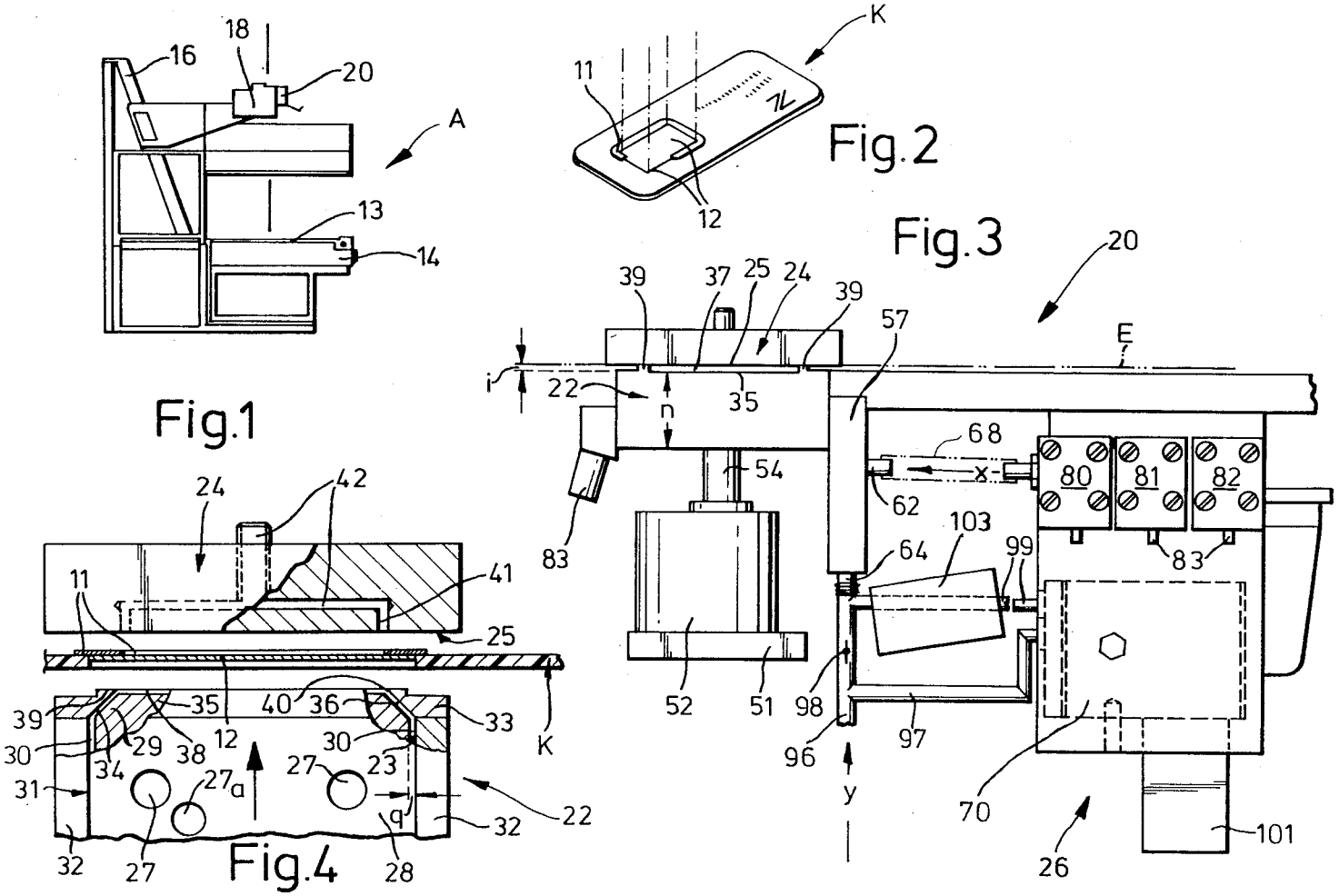
FIG. 1 shows a diagrammatic overall view of an apparatus for the treatment of film punched cards with a camera head.
FIG. 2 shows a film punched card in oblique view.
FIG. 3 shows the camera head according to FIG. 1 with development chamber and feed unit in enlarged front view.
FIG. 4 shows a partially sectional enlarged detail of FIG. 3.

An apparatus A for processing film punched cards K, which each contain a rectangular film sheet 12—surrounded by an adhesive tape 11—in an aperture, consists essentially of a camera table 14 with carrier surface 13 for documents or the like to be photographed and a camera 18 with camera head 20 mobile on a frame 16. The camera head 20 is exchangeable and is fixed precisely by a mounting which is not reproduced in the drawing, for the reason of better clarity.

The camera head 20 comprises inter alia, according to FIG. 3, for the one part a development chamber 22 for the development of the emulsion coating (not recognisable in the drawing) of a film sheet 12 previously exposed elsewhere in the camera head 20 and a presser plate 24 provided above the development chamber 22 and card plane K, and for the other part a feed unit 26 to the development chamber 22 for several flow media, to be explained later.

The development chamber 22 contains a chamber body 28 with bevelled upper side edges 29 and adjoining front grooves 30 in the front faces 31 of a width b. Each front groove 30 is covered by a lateral face plate 32 and forms therewith a side slot 23, $23_e$ of a depth q which extends substantially over the whole height n of the chamber body 28. In the latter two bores 27 for heating cartridges and a further bore $27_a$ for a security against overheating extend parallel with the front plate 32.

A cover frame 33, the two lateral inner edges 34 of which are inclined in adaptation to the bevelled side edges 29 of the chamber body 28 and define therewith a gap 36 which continues in the end groove 30, stretches over the chamber body 28.

From the cover frame 33 a frame rib 39 surrounding its frame opening 38 extends upwards, which is bevelled off on the inside to a knife-sharp sealing edge 40. The interval determined by the longitudinal sides of the frame rib 39 is designated by t in FIG. 6. The contour of the frame rib 39 lies within the edges of the film sheet 12; if the development chamber 22 is lifted out of its rest position as shown in FIG. 4 to the film punched card K, there reproduced as over-raised, then the frame rib 39 applies itself all round to the film sheet 12, namely within the film sheet zone which is covered by the adhesive tape 11.

In FIG. 4 the presser plate 24 also stands at an over-raised distance from the film punched card K—in fact it lies against the under-surface 25 of the presser plate 24. Four openings 41 of an air-conduction system 42 extending in the presser plate 24 are situated at the four corners of the free area of the film sheet 12. In this closed position there is, between the under side of the film sheet 12 and the surface 35 of the chamber body 28, a gap chamber 37 the height i of which of about 0.25 mm. is determined by the height of the frame rib 39. This dimension i also corresponds approximately to the mentioned slot depth q of the side slot 23.

The development chamber 22 is seated on a retaining plate 44 which in turn is firmly connected with two guide rods 46. These extend axially through guide bushes 47 and a base plate 45 carrying the latter and end in a dish head 48 at a distance from the base plate 45. Between this and a disc-type formed-on portion 49 of the base plate 45 a helical spring 50 surrounds the guide rod 46. According to FIG. 6 the base plate 45 is secured by side plates 51 to a retaining element indicated at 55.

Between the guide bushes 47 a pneumatic cylinder 52 is screwed at 53 on the base plate 51, the piston rod 54 of which cylinder is fast by its free end to an intermediate bolt 63 of that retaining plate 44; the pneumatic unit 52/54 renders possible a controlled raising of the retaining plate 44 and of the development chamber 22 arranged thereon, against the force of the helical springs 50, and subsequent lowering.

57 designates a switch-over device for the charging of the development chamber 22 with the mentioned flow media. This device comprises a tubular body 58 with an axial tube interior 60, $60_a$, $60_b$ which is stepped twice forming two annular shoulders 59, $59_a$, also an upper radial pipe connector 61 thereon. Moreover with the latter there is associated, on the other side of the tubular body 58, a further radial pipe connector 62 which is offset downwards on the tubular body 58 by an amount h in relation to the upper pipe connector 61. The upper pipe connector 61 of the switch-over device 57 is mounted in sealed manner in a bore of the face plate 32 and opens into the adjacent side slot 23.

A piston tube 64 is axially movable in the tube interior 60, $60_a$, $60_b$, which as stated widens upwards by steps. When the piston tube 64 is in the position as reproduced in FIG. 7 a head disc 66 connected with it lies against a sealing layer 65 of an upper covering $65_a$ of the switch-over device 57, so that a free passage exists from the lower pipe connector 62 by way of the tube interior $60_a$, $60_b$ to the upper pipe connector 61 to the end groove 30. In this position the switch-over device 57 is set so that the feed unit 26 is connected—through a conduit 68—with that side slot 23, the gap chamber 37 and the other side slot $23_e$ as flow chamber.

Figures 5, 6, 7, 8:
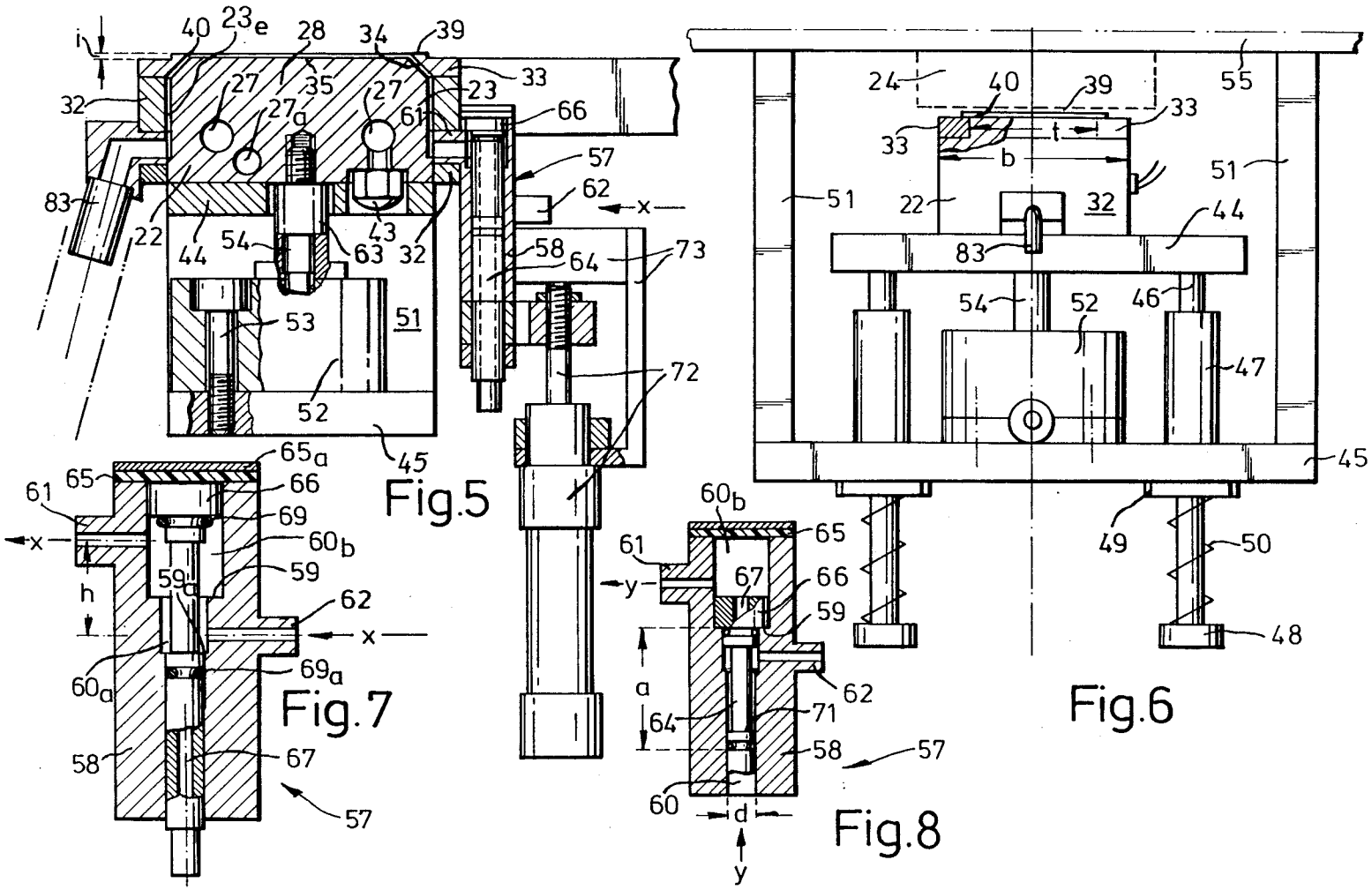
FIG. 5 shows the partially sectional development chamber in enlarged illustration compared with FIG. 3.
FIG. 6 shows a lateral elevation of FIG. 5, partially in section.
FIG. 7 shows an enlarged detail of FIG. 5.
FIG. 8 shows the detail according to FIG. 7 in a changed operational position.

After the transference of the switch-over device 57 into the other working position has taken place the head disc 66 rests according to FIG. 8 with interposition of an O-ring 69 on the annular shoulder 59 and thus separates the lower pipe connector 62 from the upper pipe connector 61. Now the latter is open by way of the tube chamber $60_b$ to the axial bore 67 of the piston tube 64.

The piston tube 64 is of relatively small diameter below its head disc 66 and widens, at a distance a from the head disc 66, at 71 in step form to the diameter d of the lower tube interior chamber 60. Beneath the step 71 a further O-ring $69_a$ is arranged on the piston tube 64; the two O-rings 69, $69_a$ define an annular chamber which adjoins the bore of the lower pipe connector 61 and at the same time closes it in this working position.

The switch-over movements as described of the piston tube 64 are controlled by means of a pneumatic cylinder-piston unit 72 which is fast on a frame part 73.

Figure 10:
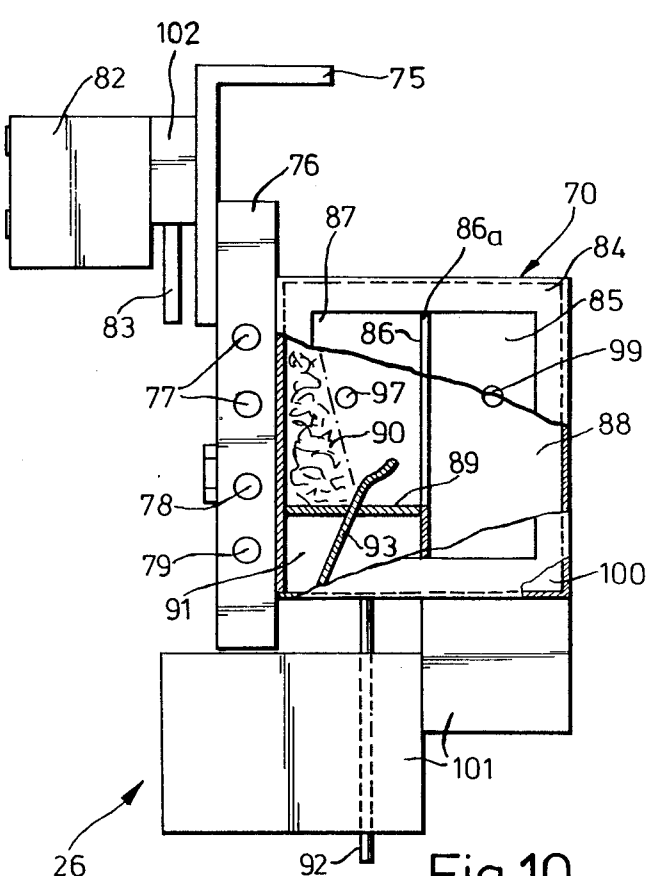
FIG. 10 shows a partially sectional lateral view of FIG. 9.
Figure 9:
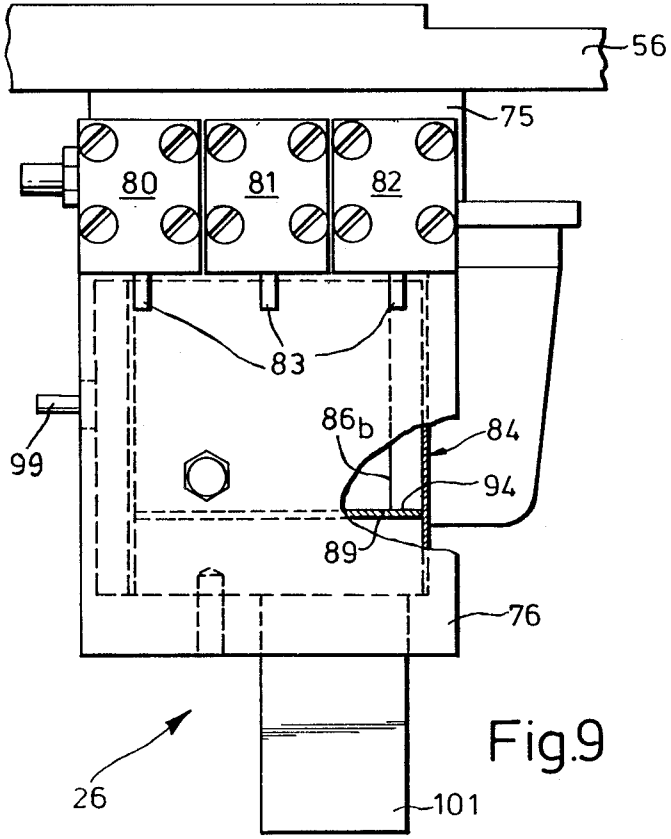
FIG. 9 shows the partially broken-away front view of the feed unit according to FIG. 3.

The feed unit 26 includes an approximately vertical heating plate 76 with heating cartridges 77, safety device 78 and regulator 79. The heating plate 76 is suspended vertically on a carrier angle piece 75 which moreover carries three valves 80, 81 and 82 which are connected each through a pipe connector 83 to a vessel (not shown) for developer, fixing fluid and water respectively. On the other side of the heating plate 76 a parallelepipedic and water-tight housing 84 is provided as part of an air moistener 70 which contains in the front, which is visible in FIG. 10, a transparent wall pane 85 of acrylic glass and in the interior a central vertical wall 86 dividing the housing interior, of which wall one edge $86_a$ extends partially with spacing from the wall pane 85 and forms a gap 94 therewith. The left part of the housing interior in FIG. 9 is divided by a horizontal transverse wall 89. The consequent upper chamber 87 is completely filled with cotton wool 90 or a similar fleece which is provided with moisture from a feed chamber 91, as it is called, lying beneath the transverse wall 89. Into the feed chamber 91 there opens a narrow water feed 92 for water supply by drops; the water is conducted further into the upper chamber 87 lying thereabove by means of a wick 93 passing through the transverse wall 89. A neighbouring separation chamber 88 is free from fleece inserts or the like fittings.

For the development of the exposed film sheet 12 the latter is pushed in between the presser plate 24 and the development chamber 22, which is uniformly heated thanks to the heating cartridges in the bores 27 and a regulating sensor 43, and the development chamber 22 is guided upwards in the stroke direction until the film punched card K rests clamped in the camera head 20. Now vacuum is applied to the air conduction system 42 of the presser plate 24, so that the surface of the film sheet 12 closely rests flat on the under surface 25 of the presser plate 29. The switch-over device 57 is situated in the fluid-passage position as shown in FIG. 7, that is the head disc 66 lies against the sealing layer 65, the way between the lower pipe connector 62 and the upper pipe connector 61 is open. Water flows through the likewise opening valve 82 of the feed device 26 to the forward side slot 23 into the gap chamber 37 and there waters the emulsion coating of the film sheet 12, in order then to pass through the other side slot $23_e$ to a discharge pipe 83. Thence the water—and then each of the subsequently mentioned fluids too—is fed to a collecting vessel which is neglected in the drawing.

The gap chamber 37 between the surface 35 of the chamber body 28 and the emulsion coating of the film sheet 12 is now flooded with developer which takes the route as described above, by way of the valve 80. This chemical substance remains stationary in the gap chamber 37—and thus in the development chamber 22—until the development operation is concluded.

Then the developer is removed through the discharge pipe 83; on closing of the developer valve 80 and opening of the adjacent valve 81 for fixing fluid the developer is exchanged for fixer, without opening of the development chamber 22. The fixer too remains in the gap chamber 37 until the fixing operation is concluded, whereafter the fixer leaves the development chamber 22 likewise through the discharge pipe 83.

Now water is pumped over the entire watering period in the flow direction x through the gap chamber 37 in order to achieve an optimum watering of the emulsion coating. With this water current the remaining chemicals are rinsed away out of the whole conduit system and also from the gap chamber 37, so that these parts of the apparatus are fully cleaned.

For the now following drying the switch-over device 57 changes over from the operational condition (fluid path open) as shown in FIG. 7 into the operational condition according to FIG. 8 (air path open); air introduced in the direction of the arrow y into the axial bore 67 issues at the head disc 66 into the head space $60_b$ of the tube interior space and thence passes by way of the pipe connector 59 into the gap chamber 37. The fluid (water) which may have remained there is thus forced with a sharp air jet into the discharge pipe 83, while at the same time the emulsion coating of the film sheet 12 is quickly dried.

For the avoidance of droplet formation on the emulsion coating, that is of variations of coating thickness, an intermediate moistening now takes place. In FIG. 3 below the switch-over device 57 an air feed pipe is indicated at 96 which upwardly adjoins the axial bore 67 of the piston tube 64 and is provided with a branch conduit 97—to the described water-tight housing 84 of the air moistener 70. On closing of a flap 98 air for moistening is conducted into this branch conduit 97 into the upper chamber 87 of the air moistener 70 and there flows into the cotton wool filling 90. In the passage of the air through the cotton wool filling 90 the air is moistened and deflected around the edge $86_a$ of the vertical wall 86, that is through the gap 94, into the adjacent separation chamber 88, flows through the latter and is withdrawn therefrom through a pipe 99. In the separation chamber 88 drops present in the blown air are separated, collected downwards in a trough and withdrawn by way of a water extraction valve 101.

The moistened air issuing from the flow or separation chamber 88 passes through the pipe 99 back to the air feed pipe 96, while the pipe 99 passes through a heating device indicated symbolically at 102 which guarantees a temperature by virtue of which no condensation of any kind of the moist air into the development chamber 22 takes place. When the intermediate moistening is terminated the by-pass 97–99 is closed, so that dry air flows afresh through the feed pipe 96 to the development chamber 22. The latter carries out a final drying process.

Since the chemicals are heated in a pre-heating system (in 103) to their processing temperature and processing temperature also prevails in the gap chamber 37 itself, the chemicals arrive on the emulsion coating with the actually necessary temperature—thus they experience no evaporation cooling by spraying and can also absorb no additional oxygen. Therefore the chemicals are able to act optimally upon the emulsion coating, which results in short processing times with finest grain and thus optimum utilisation of the sharpness of the treated film.

The filling quantities for the filling of the development chamber are extraordinarily small; they amount for developer and fixer to about 4 cc., for water to about 40 cc. The processing temperature lies—in dependence upon the room conditions—at between 35° and 38° C. +0.5° C.

The example of embodiment as described here is conceived for black and white films; an example (not reproduced) for the production of coloured film sheets 12 of course also contains additional valves, conduits and the like for the colour picture process.

I claim:

1. Apparatus for developing an emulsion coating of a film strip, said apparatus comprising:

a development chamber limited on one side by the emulsion coating, said chamber being subjected to the action of at least one fluid;

said development chamber comprising a gap chamber (37) of substantially rectangular plan and of a height (i) of about 0.1 to 1.0 mm.;

said gap chamber being limited by a first surface (35) of a heated chamber body (28);

said heated chamber body having a height (n);

a carrier surface for positioning the emulsion coating on said film strip, said carrier surface being determined by a rib (39) and a seal edge (40) on a cover frame (33), said seal edge being arranged between said heated chamber body surface and said emulsion coating on said film strip;

said heated chamber body surface being bevelled off on each of two edges crossing a direction of flow (x) of said at least one fluid;

each bevelled edge adjoining a respective side groove extending along a side of said heated chamber body over approximately the entire height (n) of said heated chamber body;

said bevelled edges and said side grooves forming part of a flow-gap (23,23$_e$) of a depth (q) extending over substantially the whole height (n) of said heated chamber body and over a substantial portion of the heated chamber body surface (35);

said flow gap (23,23$_e$) being connected to a fluid inlet (61) and a fluid outlet (83); and at least one fluid supply (62,96) communicating with said flow gap via said fluid inlet and said fluid outlet.

2. Apparatus according to claim 1 characterized in that the flow gap depth (q) substantially corresponds to the height (i) of said gap chamber.

3. Apparatus according to claim 1 characterized in that:

said heat chamber body is formed by a metal block having at least one bore for a heating cartridge, said at least one bore extending parallel to said first surface;

said heat chamber body further including safety means for providing security against overheating;

said cover frame possessing inner surfaces (34) parallel to said bevelled edges (29) of said chamber body; and said chamber body further including lateral face plates (32) covering said grooves (30), each said face plate adjoining said cover frame.

4. Apparatus according to claim 1 further characterized by a sensor (43) for a regulator being provided in said chamber body.

5. Apparatus according to claim 1 further characterized by:

a presser plate movable in relation to said development chamber (22), said presser plate containing an air conduction system (42) with openings (41) pointing to the development chamber.

6. Apparatus according to claim 5 further characterized by mounting means for lifting said development chamber towards and lowering said development chamber away from said presser plate (24).

7. Apparatus according to claim 5 further characterized by:

said presser plate having four openings (41) pointed towards the development chamber, each said opening being connected to said air conduction system; and each said opening being arranged in a corner zone of said cover frame, each said corner zone being formed by said seal edge and said frame rib.

8. Apparatus according to claim 1 further characterized by:

said development chamber (22) being mounted on a movable retaining plate (44);

said retaining plate being moved by at least one of a pneumatic and a hydraulic unit (52/54); and a base plate (45) carrying said at least one of a pneumatic and a hydraulic unit for guiding said retaining plate.

9. Apparatus according to claim 1 further characterized by:

a fluid supply (62) and an air supply (96) connected to said fluid inlet (61); and means for alternately connecting said fluid supply and said air supply to said fluid inlet, said connecting means comprising a switch-over device (57).

10. Apparatus according to claim 9 further characterized by:

said switch-over device (57) comprising a tubular body and a piston displaceable in said body;

said piston having a piston tube (64), a head disc (66) and an axial bore (67) communicating with at least one of a development medium and said air supply;

said tubular body having a radially protruding feed to the development chamber and a pipe connector, said pipe connector being offset with respect to said radially protruding feed;

said head disc in a first position separating said radially protruding feed from said pipe connector and forming a head chamber (60$_b$) with said tubular body; and said axial bore communicating with said head chamber when said head disc is in said first position so as to introduce said at least one of a development medium and said air to the fluid inlet.

11. Apparatus according to claim 10 further characterized by:

said tubular body having a sealing element (65);

said axial bore (67) being closed by said sealing element (65) when said piston and said head disc are in a second position; and said radially protruding feed and said pipe connector being in fluid communication with each other when said piston and said head disc are in said second position.

12. Apparatus according to claim 11 further characterized by said sealing element (65) forming part of a closure (65/65$_a$) of said tubular body (58).

13. Apparatus according to claim 10 further characterized by:

said tubular body having a tapered central bore portion including at least one step forming at least one annular shoulder (59,59$_a$), whereby said head disc separates said radially protruding feed from said pipe connector when in said first position by contacting said at least one annular shoulder and thereby forming a blocking stop.

14. Apparatus according to claim 10 further characterized by:

an air flow channel (96) communicating with said axial bore for feeding air to said development chamber;

means for moistening said air being provided to said development chamber;

said moistening means comprising an air moistening device (70), a first by-pass conduit (97) for delivering air from said flow channel to said moistening device, a second by-pass conduit (99) for delivering moistened air from said moistening device to said air flow channel, and a blocking device (98) in said air flow channel intermediate said first and second by-pass conduits for preventing a direct air feed to said axial bore.

15. Apparatus according to claim 14 further characterized by:

means (103) for heating said moistened air; and said second by-pass conduit passing through said heating means prior to delivering said moistened air to said flow channel.

16. Apparatus according to claim 14 further characterized by:

said air-moistening device being formed as a double chamber arrangement (87,88) on a heating plate (76); and a first chamber (87) being filled with a cotton wool filling accommodating a fluid in a first flow direction (y) of said air.

17. Apparatus according to claim 16 further characterized by:

said first chamber (87) merging into a second chamber (88) at a deflecting edge (86); and said second by-pass conduit (99) extends from an end wall of said second chamber remote from said deflecting edge.

18. Apparatus according to claim 16 further characterized by:

means for providing at least one of a developer, a fixer and water to said pipe connector of said tubular body;

said providing means being fitted to said heating plate and having at least one outlet communicating with said pipe connector; and said providing means further including at least one of a conduit and a valve.

* * * * *